US005417818A

United States Patent [19]

Linhard

[11] Patent Number: 5,417,818

[45] Date of Patent: May 23, 1995

[54] PROCESS FOR THE ACCELERATED ETCHING AND REFINING OF METALS IN AMMONIACAL ETCHING SYSTEMS

[75] Inventor: Andreas Linhard, Owingen, Germany

[73] Assignee: Elo-Chem Atztechnik GmbH, Germany

[21] Appl. No.: 157,905

[22] Filed: Nov. 24, 1993

[51] Int. Cl.[6] ..... C25F 3/02; C25F 7/02

[52] U.S. Cl. ..... 204/129.1; 204/130

[58] Field of Search ..... 204/129.1, 130, 91, 204/106

[56] References Cited

U.S. PATENT DOCUMENTS 4,280,887 7/1981 Konstantouros ..... 204/130 X
4,490,224 12/1984 Warheit ..... 204/130
4,545,877 10/1985 Hillis ..... 204/130
4,557,811 12/1985 Fürst et al. ..... 204/130 X
5,248,399 9/1993 Meguro et al. ..... 204/130

*Primary Examiner*—Donald R. Valentine
*Attorney, Agent, or Firm*—Brown, Martin Haller & McClain

[57] ABSTRACT

Traditional recommendations consider the nitrate that occurs in the electrolysis cell as an interfering factor and attempt to remove the nitrate completely or largely from the etching solution. In accordance with the invention, it is recommended to operate the etching installations with a certain optimum nitrate content which brings about a considerable acceleration of etching speed and to realize an upper limit only by adding reducing agents whereby the reducing agents have the added advantage that for example in the electrolysis cell they favor the conversion from copper II to copper I.

7 Claims, No Drawings

PROCESS FOR THE ACCELERATED ETCHING AND REFINING OF METALS IN AMMONIACAL ETCHING SYSTEMS

BACKGROUND OF THE INVENTION

Etching systems that operate with ammoniacal etching reagents are particularly suitable for the regeneration of the etching reagent in recycling processes in which at the same time the etched metal is refined metallically in electrolysis cells.

In terms of commercial application, it is of great importance that the etching speed as well as refining speed of the metal in the electrolysis cell be accelerated.

It is also important that to the extent possible the substances that result from etching or regeneration or refining of the metal do not bring about any excessive enrichment. Interference from secondary reactions should be avoided to the extent possible.

SUMMARY OF THE INVENTION

Task of the invention is to outline a process which reaches this ideal goal as closely as possible.

In this regard, the invention is attributed special significance in that it utilizes in a positive fashion the interference of secondary phenomena found in traditional systems with electrolysis cells, i.e. the occurrence of oxygen and, as a secondary reaction, the oxidation of ammonium ions to nitrate.

Patent DE 42 18 843 A1, for example, describes a process which proposes the removal of nitrate from the etching reagent through reaction with a reducing agent.

It completely disregarded the accelerating effect of the etching process by the nitrate, which no longer applies when removed from the etching reagent, not even with a residual concentration between 10 and 40 g/l.

DETAILED DESCRIPTION OF THE PREFERRED EMBODIMENT

In accordance with the invention, the nitrate that occurs on the electrodes of the electrolysis cell in the etching reagent is enriched to a value of at least 50 to 200 g/l. This makes it possible to achieve a significant acceleration of the etching process.

In order to prevent an excessive nitrate concentration, it is recommended to add reducing agents as soon as values rises too much.

As a particularly effective reducing agent, formaldehyde is recommended, which is a proven product in the electroplating area.

But an increased nitrate concentration in conjunction with reducing agents, added in accordance with the invention, also improves the refining of metals in the electrolysis cell, since for example for copper, the necessary reduction from copper II to copper I—required for the metallic refining of copper—is accelerated.

Etching with high nitrate content as proposed in accordance with the invention also offers the advantage that it is very suitable for use in certain acceleration additions, e.g. on the basis of compounds that contain vanadium.

In accordance with the invention, the addition of accelerators containing selenium or cobalt is also proposed.

Since the recommended processes do not bring about any substances that affect the etching process, the advantages are obvious.

Examples of etching solutions in accordance with the invention with trades of vanadium as accelerator are:

| | |
|---|---|
| Solution 1: | 60–120 g Cu/l |
| | 120–220 g $SO_4$/l |
| | 70–100 g $NO_3$/l |
| | 0.5–5 g Cl/l |
| | 1–20 mg V/l |
| Solution 2: | 60–120 g Cu/l |
| | 120–220 g $SO_4$/l |
| | 70–100 g $NO_3$/l |
| | 0.5–5 g Cl/l |
| | 0.5–20 g $PO_4$/l |
| | 1–20 mg V/l |

In addition, solutions 1 and 2 contain ammonia for setting the alcalic pH value.

It is known that the etching speed is a function of temperature and pH value. For the examples of the etching solutions in accordance with the invention, optimum temperatures were 35° C. to 60° C. with a pH value of 8.1 to 8.8 and a nitrate concentration of 70–80 g/l.

The addition of reducing agents to avoid excessive nitrate concentrations is not critical. In most cases, a weekly analysis and addition are sufficient.

Obviously, it is also possible to foresee an on-going addition, e.g. with dosing pumps, because the nitrate formation of the refined copper amount corresponds proportionately to the current balance of the electrolysis cell and can therefore easily be calculated in advance.

Especially in the continuous additional dosage of reducing agents, it is recommended to do this in the area of the electrolysis cell. e.g. at the intake, so that a better result is obtained, e.g. in the conversion form copper II to copper I.

I claim:

1. Process for the accelerated etching with ammoniacal etching reagents and subsequent regeneration of the etching reagent, comprising refining an etched metal in an electrolysis cell wherein nitrate occurs in the etching reagent during electrolysis, and enriching the nitrate up to a concentration of at least 50 to 200 g/l.

2. Process in accordance with claim 1 including addition of reducing agents to prevent the nitrate concentration from increasing excessively beyond an optimum operating point.

3. Process in accordance with claim 2 whereby formaldehyde is added as a reducing agent.

4. Process in accordance with claim 2 whereby the reducing agent is added in the area of the electrolysis cell.

5. Process in accordance with claim 1 whereby an accelerator containing vanadium is also added to the etching reagent.

6. Process in accordance with claim 1 whereby an accelerator containing selenium is added.

7. Process in accordance with claim 1 whereby an accelerator containing cobalt is added.

* * * * *